US005914022A

United States Patent [19]

Lowry et al.

[11] Patent Number: 5,914,022

[45] Date of Patent: Jun. 22, 1999

[54] METHOD AND APPARATUS FOR MONITORING AND CONTROLLING ELECTRODEPOSITION OF PAINT

[76] Inventors: Patrick Ross Lowry, 3139 Moriah Trails #208, Memphis, Tenn. 38115; Roger L. Smith, 1474 Tuscany Way, Germantown, Tenn. 38138; Oleg Vladimir Dobrusin, 1460 Cherry Rd. #32, Memphis, Tenn. 38117

[21] Appl. No.: 08/908,562

[22] Filed: Aug. 8, 1997

Related U.S. Application Data

[63] Continuation of application No. 08/583,708, Jan. 5, 1996, abandoned.

[51] Int. Cl.[6] ..... C25D 21/12; C25D 5/02; C25D 17/00; C25D 1/12

[52] U.S. Cl. ..... 205/83; 205/128; 205/145; 204/471; 204/473; 204/499; 204/512; 204/204; 204/205; 204/228

[58] Field of Search ..... 205/83, 128, 145, 205/474, 512; 204/471, 473, 512, 499, 204, 205, 228

[56] References Cited

U.S. PATENT DOCUMENTS 3,855,106 12/1974 Campbell et al. ..... 204/498
4,240,881 12/1980 Stanya ..... 205/83
4,517,059 5/1985 Loch et al. ..... 205/83
4,699,694 10/1987 Backelandt et al. ..... 205/83
4,824,538 4/1989 Hibino et al. ..... 204/512

FOREIGN PATENT DOCUMENTS 4-165099 6/1992 Japan .

*Primary Examiner*—Kathryn Gorgos
*Assistant Examiner*—Edna Wong

[57] ABSTRACT

A method and apparatus for monitoring electrodes for the electrodeposition of paint onto metallic workpieces includes detecting current from the electrodes and displaying a plot of current versus time. A method and apparatus for controlling electrodeposition of paint onto metallic workpieces includes monitoring current from electrodes over time and adjusting a rate of current increase over time. The monitor and/or control may be performed for each electrode individually or for the electrodes as a group. The monitor and/or control allows bad and/or poorly positioned electrodes to be located. The monitor and/or control may be used to stop the electrodeposition coating after a sufficiently thick coating has been obtained.

23 Claims, 4 Drawing Sheets

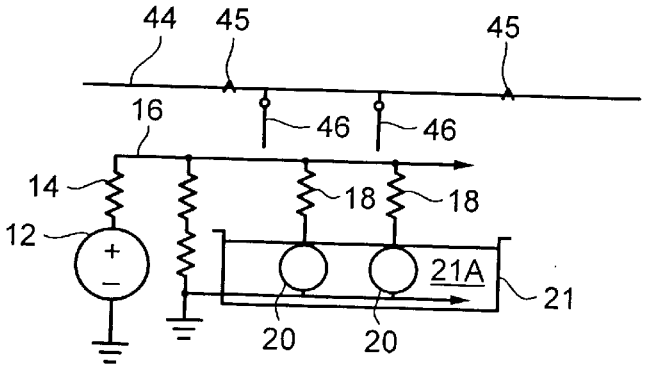
FIG. 3A
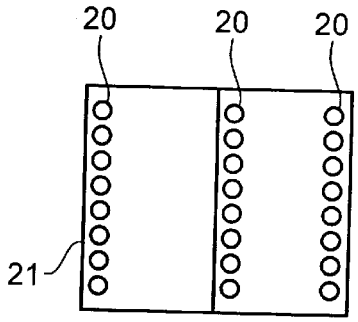
FIG. 3B
FIG. 3C
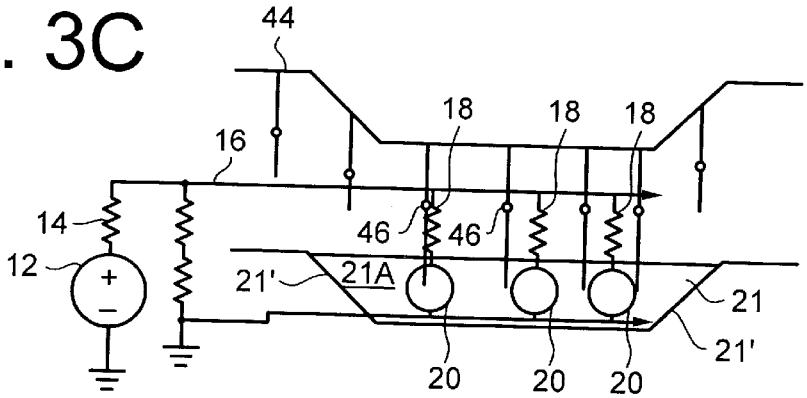
FIG. 3D
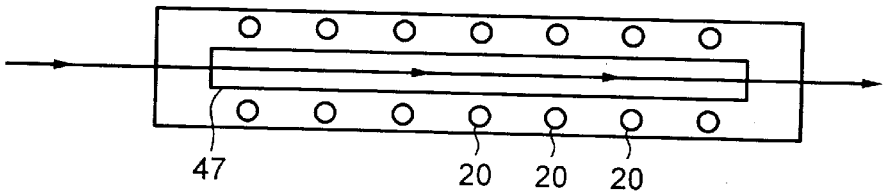

METHOD AND APPARATUS FOR MONITORING AND CONTROLLING ELECTRODEPOSITION OF PAINT

This application is a continuation of application Ser. No. 08/583,708 filed on Jan. 5, 1996, now abandoned.

BACKGROUND OF THE INVENTION

1. Field of the Invention

The present invention is directed to a system and method for monitoring and/or controlling electrodeposition coating of metallic workpieces, and, more specifically, to a system and method for forming an accurate one-pass coating.

2. Description of Related Art

Previous attempts to check for inefficient electrode placement or the death of electrodes involved workpiece inspection. Such checking was based on the assumption that all of the electrodes had the same life cycle, so all electrodes were replaced simultaneously. Further, since the characteristics of the system were not directly monitored, excess paint was typically applied to ensure a sufficient coating. This resulted in increased materials cost, increased manufacturing time and typically less than optimal, i.e., too thick, coatings.

Such a routine is clearly laborious, does not allow the correction of the voltage applied to the electrodes during deposition, does not allow individual electrodes to be monitored or easy assessment of the positioning of the electrodes relative to the workpieces.

SUMMARY OF THE INVENTION

Accordingly, a primary object of the present invention is to monitor and control the voltage applied to electrodes during deposition of paint. It is a further object of the present invention to provide such monitoring and controlling for both individual electrodes and the electrodes as a group. It is yet a further object of the present invention to permit assessment of whether positioning of the electrodes relative to the workpieces is effective.

These and other objects of the present invention are fulfilled by providing a process for monitoring electrodeposition coating of paint on workpieces comprising the steps of positioning the workpieces adjacent to a plurality of electrodes, electrodeposition coating the workpieces, detecting current from said plurality of electrodes, and displaying a plot of current output from the detecting step versus time. The displaying may include displaying a plot of current versus time for each of the plurality of electrodes and/or displaying a plot of total current versus time for all of the plurality of electrodes.

The detecting step may also include detecting electrodes associated with more than one voltage rectifier for paint electrodeposition and switching detecting between electrodes associated with the voltage rectifiers.

These and other objects of the present invention are fulfilled by providing a process for controlling electrodeposition coating of paint on workpieces comprising the steps of positioning the workpieces adjacent to a plurality of electrodes, electrodeposition coating the workpieces, monitoring current from the plurality of electrodes, and adjusting a rate of current increase over time relative to predetermined parameters.

The adjusting step may include determining whether the rate of current increase is too fast and decreasing a slope of the voltage supplied to the electrodes if said rate of current increase, is too fast. The adjusting step may include determining whether the rate of current increase is too slow and increasing a slope of the voltage supplied to the electrodes if the rate of current increase is too slow. The adjusting step may include determining whether the rate of current increase is too fast and decreasing a conveyance speed of the workpieces if the rate of current increase is too fast. The adjusting step may further include determining whether the rate of current increase is too slow and increasing a conveyance speed of the workpieces if the rate of current increase is too slow.

The controlling process may further include monitoring voltage across the plurality of electrodes and preventing the rate of current increase over time from exceeding a rate of voltage increase over time.

The controlling process may also include determining whether a peak current has been reached. The controlling process may further include assessing whether this peak current exceeds a predetermined current and outputting a warning signal when the assessing step indicates the peak current is less or greater than the predetermined current.

The controlling process may also include monitoring a rate of current decrease over time and stopping the electrodeposition coating when the rate of current decrease indicates a desired thickness of paint on the workpieces has been reached.

These and other objects of the present invention are fulfilled by providing a system for monitoring electrodes in an electrodeposition tank which includes a display, a detector which detects current from the electrodes during electrodeposition, and a connector which connects the detector to the display to display a plot of current versus time for the electrodes. The display may simultaneously display a plot for each of the electrodes.

The detector may include a detector for each of the electrodes and the connector may include a selector which selects among the rectifier, and hence all the electrodes connected to it. An analog-to-digital converter converts signals received from the selector into digital form to be output to the display. The display itself may then select which electrodes to display.

These and other objects of the present invention may be achieved by providing a system for controlling electrodes in an electrodeposition tank including a monitor unit for monitoring a plot of current versus time for the electrodes and a control unit for controlling a slope of the plot. The control unit controls the slope by controlling at least one of a speed of conveyance of the workpieces and the voltage supplied to the electrodes.

These and other objects of the present invention will become more readily apparent from the detailed description given hereinafter. However, it should be understood that the detailed descriptions or specific examples all indicating preferred embodiments of the present invention, were given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein:

FIG. 3*a* is a schematic side view of an electrodeposition coating apparatus for use with the monitor/control of the present invention;

FIG. 3*b* is a schematic side view of the apparatus shown in FIG. 3*a;*

FIG. 3*c* is a schematic side view of another electrodeposition coating apparatus for use with the monitor/control of the present invention;

FIG. 3*d* is a schematic side view of the apparatus shown in FIG. 3*c.

DETAILED DESCRIPTION OF THE PREFERRED EMBODIMENTS

Figure 1:
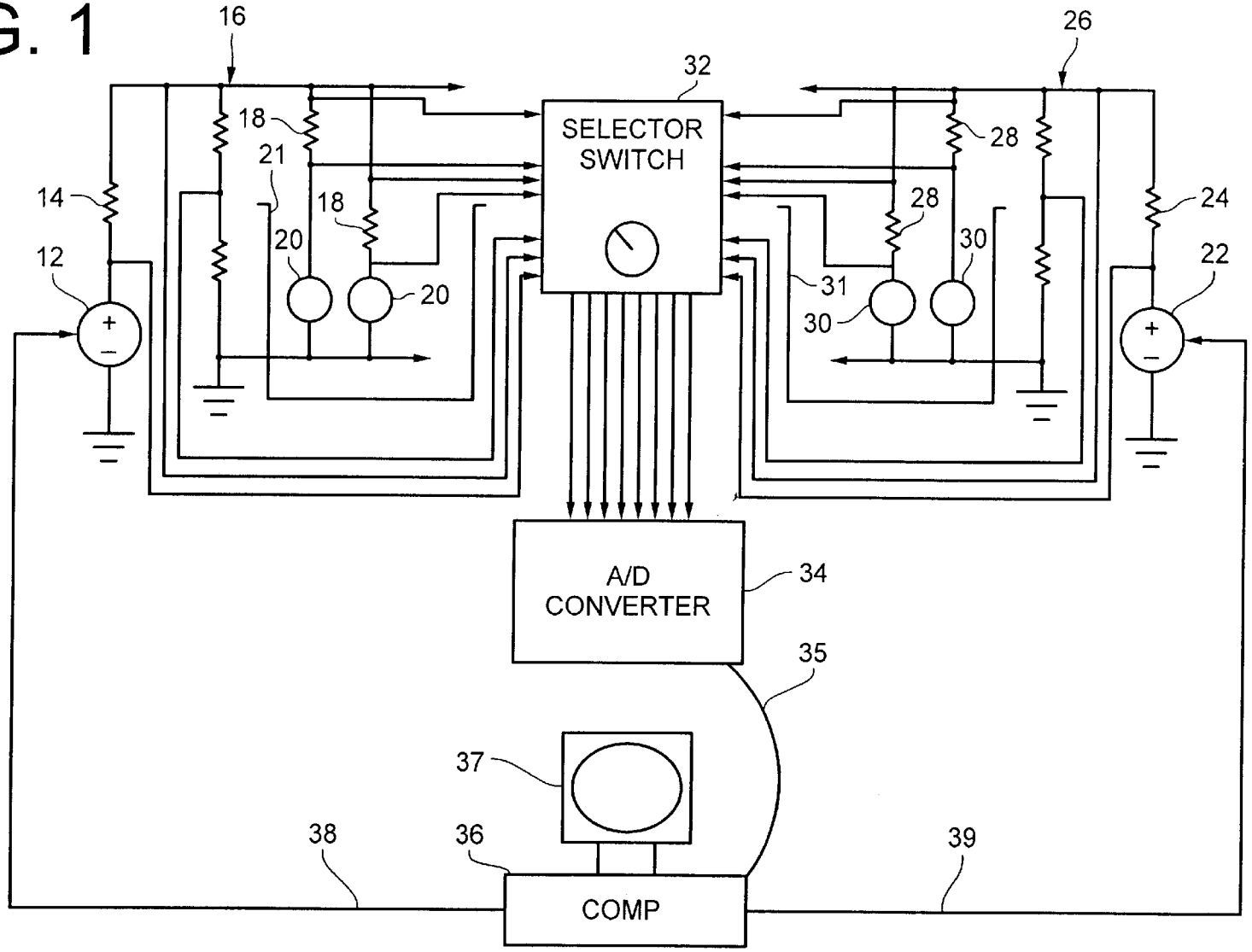
FIG. 1 illustrates an embodiment of the system of the present invention including two paint tanks.

Referring to FIG. 1, a rectifier 12 is connected through a shunt resistor 14 to a voltage divider 16 which supplies voltage through shunts 18 to anodes 20 inserted in a paint tank 21. Similarly, a rectifier 22 is connected through a shunt resistor 24 to a voltage divider 26 which supplies voltage through shunt resistors 28 to anodes 30 inserted in another paint tank 31. The paint tanks 21, 31 are grounded, thus parts in the tanks are grounded.

A selector 32 is connected to each anode 20,30 across their respective shunt resistors 18, 28; to the rectifier 12, 22 across the shunt resistor 14, 24; and to the voltage divider 16, 26. The unconnected arrows indicate a further inclusion of identical components of anodes 20, 30 and shunt resistors 18, 28.

The selector 32 is also connected to an analog-to-digital (A/D) converter 34. A serial cable 35 connects the A/D converter 34 to a computer 36. The computer 36 includes a display 37. The computer 36 is connected to the rectifiers 12, 14 through lines 38, 39, respectively.

The selector 32 allows the monitoring/controlling of these two paint tanks 21, 31 to be switched between. The selector 32 allows a particular rectifier to be selected, and then all of the electrodes connected to the rectifier may be monitored. The number of anodes in a tank will depend on the particular workpiece and type of paint. For example, it is advantageous to use forty anodes 20 in a tank 21 containing white paint and to use twelve anodes 30 in a tank 31 containing black paint. Obviously, numerous systems may be connected to the selector 32. Only tanks sharing a rectifier may be effectively monitored simultaneously through the same A/D converter.

The computer 36 also allows selecting monitoring of the current from all of the anodes 20, 30 in a tank 21, 31 via shunt resistor 14, 24 and monitoring of the current generated by each individual anode 20, 30 via shunt resistors 18, 28. Only particular electrodes 20, 30 may also be selected to be monitored.

The current being drawn across each of the shunt resistors 18 and 28 is output to the selector 32. The voltage being supplied to the anodes 20, 30 in the tanks 21, 31 may also be output to the selector 32. In accordance with the appropriate selection on the selector 32, the selector 32 outputs the inputs received from a corresponding tank which has been selected to the A/D converter 34. This A/D converter 34 outputs digital signals corresponding to the input analog signals from the selector 32 along the serial cable 35 to the computer 36. The display screen 37 of the computer 36 displays a plot or plots of the current versus time from the selected anodes. The display screen 37 may also display any warning of a bad or improperly placed anode.

During the electrodeposition coating which occurs in the tanks 21, 31, a metallic workpiece, or series of metallic workpieces, are inserted into the tank. Typically, there are as many workpieces as there are anodes 20, 30. The anodes 20, 30 charge the paint, which then adheres to the metallic workpieces. As the paint coating on the metallic workpieces becomes thicker, the film formed thereby becomes insulating. Therefore, the amount of current generated by the anodes is indicative of the thickness of the paint on the workpiece near the anode. Therefore, by monitoring this current, a user may control the deposition process by controlling the voltage supplied by the rectifiers 12, 22.

Figure 2:
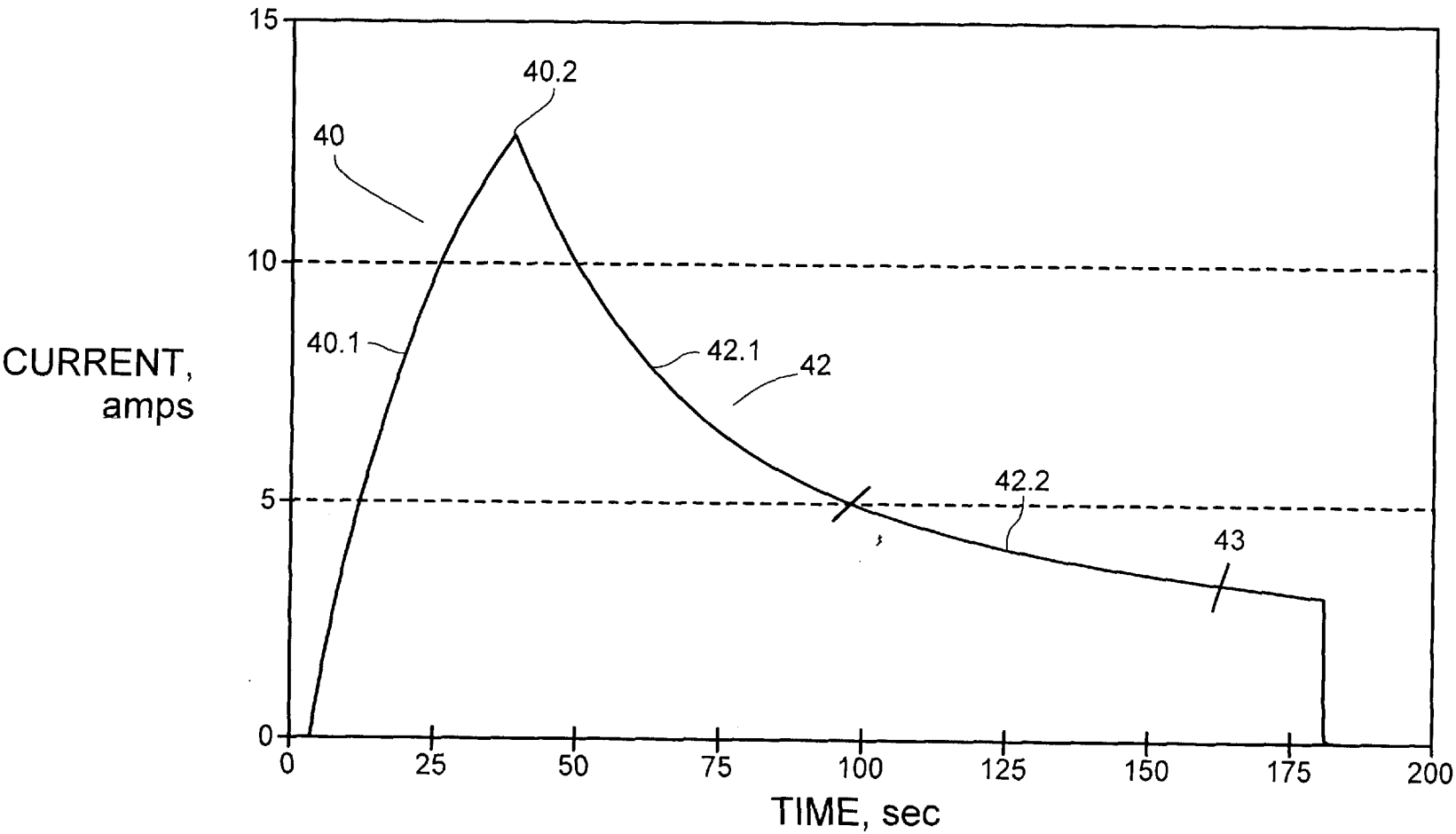
FIG. 2 is a sample current versus time plot for an electrode.

An exemplary plot of current versus time for an anode 20, 30 in one of the tanks 21, 31 is shown in FIG. 2. In this exemplary plot, epoxy electrodeposition paint having a conductance of 670 $\mu\Omega$ is applied to workpieces which are approximately 15 square feet and located 24 cm from a corresponding anode. In a first part 40 of this curve, the current is being ramped up as paint is being applied to the workpieces. The portion 40.1 represents the ramp time of the voltage and current flow to the anode an coating of the workpiece from a bare part. This portion 40.1 of the curve should be as steep as possible without approaching infinity, which would lead to paint blow-up. Quick paint build up results in the most effective coating. The inflection point 40.2 represents the maximum current draw and coating film being applied.

The trailing portion 42 of the curve should be monitored and the voltage should be stopped after the paint has reached a sufficient thickness. Depositing too much paint will both waste paint and decrease film quality. The monitoring will also allow full paint coverage of a desired thickness, e.g., 25 microns, uniformly on the workpiece. The portion 42.1 represents the current fall due to coating thickness causing an increased resistance. The portion 42.2 represents the forced coating due to a high work piece resistance coating. A point 43 represents the point at which coating is complete and the process should be terminated. The overall curve should look smooth. If the curve does not look smooth, this is a further indicator of a problem in the system.

The current of the anodes of a paint tank as a whole may be monitored by monitoring the current across the first shunt resistor 14, 24. Alternatively, the current of individual electrodes may be monitored by monitoring the currents across each anode shunt resistor 18, 28. When a full load of workpieces is being processed, the electrodes should present very similar curves. Typically, when an electrode has gone bad, it has a very low current draw and no good spike appears.

Obviously, the values of the current versus time plot will depend upon the size of the metallic workpieces, the type of paint used, the characteristics of the electrodes use, the desired coating thickness, etc. However, any such plot should possess the features of a rising portion, a peak current and a trailing portion.

The design of the tanks 21, 31 in FIG. 1 are for use in a stop and start conveyance system as shown in FIG. 3*a*. In such a system, workpieces 46 are attached in a conventional manner to a conveyor 44. Also conventionally, the conveyor 44 contains hinges 45 appropriately situated over the paint tank 21. These hinges 45 allow the workpieces 46 to be raised and lowered into the paint tank 21 containing paint 21*a*. The workpieces 46 are positioned so that they are adjacent to the electrodes 20 in the paint tank 21.

FIG. 3*b* shows a top view of the stop and start system shown in FIG. 3*a*. The arrangement of the anodes 20 running along the sides of the tank 21 is more clearly shown.

In addition to the stop and start conveyance, where the workpieces are lowered into the tank after conveyance of the workpieces has been halted, a continuous conveyance system may be employed. An example of such a monorail system is disclosed in U.S. Pat. No. 4,824,538 to Hibino et al. and is shown in FIG. 3*c*. In such a system, the conveyor 44 is sloped complementary to the paint tank 21, which has sloped end walls 21' such that workpieces 46 may be raised and lowered into the paint 21a in the paint tank 21 without interrupting conveyance of conveyor 44. In such a monorail system, workpieces 46 pass through a grounded section 47, and a potential difference is created between the anodes 20 and the workpieces 46.

FIG. 3*d* shows a top view of the monorail system shown in FIG. 3*c*. The arrangement of the anodes 20 on either side of the conveyance path 44 in which the workpieces 46 are positioned is more clearly shown.

When used with such a system, the present invention may control the current curve in FIG. 2 by increasing or decreasing the speed of conveyance in order to alter the distance between the workpiece and the electrode, either alone or in addition to altering the voltage supplied to the electrodes. Such a monorail system offers advantages over the stop and start system.

Figure 4:
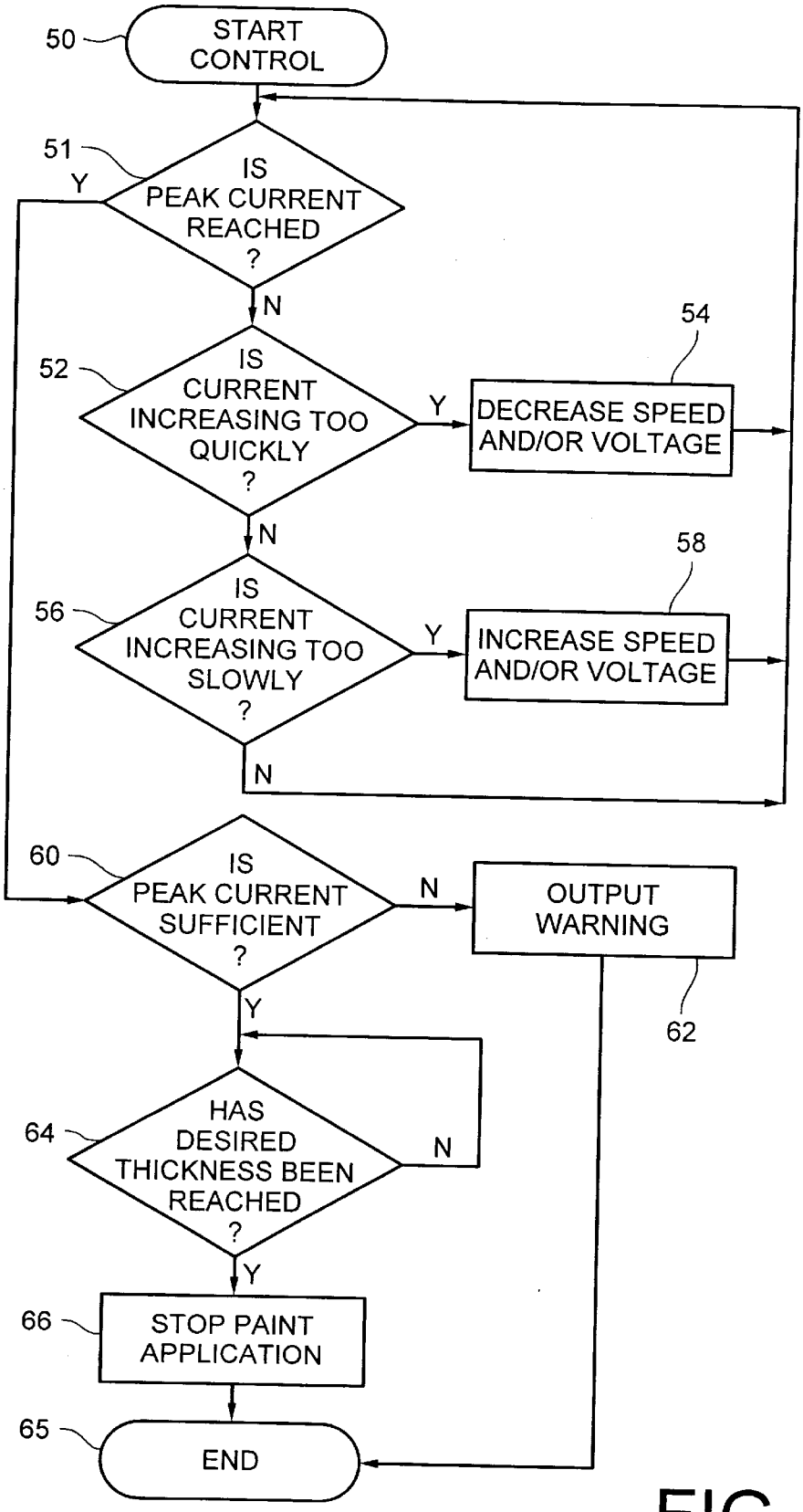
* and FIG. 4 is a flow chart for the control process of the present invention.

Based on the above information, it is apparent that the computer 38 may also be used to automatically control the system 10. This can be seen in FIG. 4, in which a process for controlling the electrodeposition coating is shown. The control process starts at step 50. Such starting may either be manually or automatically triggered. Step 51 determines whether the peak current, i.e., the global maximum, has been reached. If the peak current has not been reached, step 52 determines if the current is increasing too quickly. If voltage is being monitored as well, the slope of the current may be compared to the slope of the voltage and should not exceed the slope of the voltage. If voltage is not being monitored as well, a preselected slope may be used as the upper limit. If the current is increasing too quickly, then step 54 will either decrease the speed in a monorail system and/or decrease the slope of the voltage from the rectifier. The current may also be checked to ensure that it is increasing quickly enough at step 56. If the current is increasing too slowly, then step 58 will either increase the speed in a monorail system and/or increase the slope of the voltage from the rectifier. The control process will then begin again at step 51 to determine if the peak current has been reached and to ensure that the current has not been overcompensated.

This ramping up is continued until the peak current is reached, after which, clearly, the current slope will begin to decrease. This peak current is checked at step 60 to determine if it is sufficiently high. If it is not, a warning is output at step 62 to indicate inadequate coating and a bad or improperly positioned electrode and the process is ended. Such a warning may be visual or aural. If the peak current is sufficient, the current is further monitored at step 64 until it has reached a preselected terminal level, indicative of a desired thickness of the coating. Once this level has been reached, the coating process is terminated at step 66. This termination is achieved by either halting the supply of voltage to the electrodes or removing the workpiece from the paint. The control process then ends at step 68.

Workpiece position monitoring may also be performed by comparing the current versus time plots of the individual electrodes in a full load. Since all of these plots should look the same, any divergence of an anode from the remainder of the anodes will indicate a replacement problem which then may be remedied. Alternatively, the plots may be gathered and stored by the computer 36 when the electrodes are new to provide a baseline. Deviation from this baseline would indicate problems with the electrode or its positioning.

The above control and monitoring of the present invention is particularly useful for anything that needs to be coated in a single coat and have a class A finish. The monitoring and control reduced the amount of paint required, the coating time, and improved the coat itself. Such monitoring may be used in both anodic and cathodic electrode coating systems. The monitoring and control of the present invention also provides warning when a particular electrode is bad or improperly placed.

The invention being thus described, it will be obvious that the same may be varied in many ways. Such variations are not to be regarded as a departure from the spirit and scope of the invention, and such modifications as would be obvious to one skilled in the art are intended to be included within the scope of the following claims.

What is claimed is:

1. A method of using a computer processor to control electrodeposition coating of paint on workpieces comprising the steps of:

positioning said workpieces adjacent to a plurality of electrodes;

electrodeposition coating the point on said workpieces;

detecting current from said plurality of electrodes;

generating a plot of current output from said detecting step versus time; and using said computer to control said electrodeposition coating, including;

increasing a voltage applied to said workpieces during initial electrodeposition coating, determining when an inflection point of the plot has been attained, ceasing said increasing voltage when said inflection point has been attained, and halting said electrodeposition coating when the current falls below a preselected terminal current level indicative of a desired thickness of the electrodeposition coating, wherein said ceasing step continues to cease said increasing voltage until said halting step halts said electrodeposition coating.

2. The method as recited in claim 1, further comprising displaying the plot of current versus time for each of said plurality of electrodes.

3. The method as recited in claim 1, further comprising displaying a plot of total current versus time for all of said plurality of electrodes.

4. The method as recited in claim 1, wherein said detecting step comprises detecting current from electrodes associated with more than one voltage rectifier for paint electrodeposition and switching the detecting between the electrodes associated with said more than one voltage rectifier.

5. The method as recited in claim 1, further comprising outputting a warning signal when said computer assesses that a maximum current draw detected by said detecting current step is less than a preset current draw.

6. A method for controlling electrodeposition coating of paint on workpieces comprising the steps of:

positioning said workpieces adjacent to a plurality of electrodes;

electrodeposition coating the point on said workpieces;

detecting current from said plurality of electrodes; and adjusting a rate of current increase over time relative to preset parameters, including increasing a voltage applied to said workpieces during initial electrodeposition coating, determining when a maximum current draw has been attained, ceasing said increasing voltage when said maximum current draw has been attained, and halting said electrodeposition coating when the current falls below a preselected terminal current level indicative of a desired thickness of the coating, wherein said ceasing step continues to cease said increasing voltage until said halting step halts said electrodeposition coating.

7. The method as recited in claim 6, further comprising:

detecting voltage across said plurality of electrodes; and preventing said rate of current increase over time from exceeding a rate of voltage increase over time.

8. The method recited in claim 6, further comprising using a computer processor to determine whether the maximum current draw has been attained.

9. The method as recited in claim 8, further comprising using the computer processor to assess whether said maximum current draw exceeds a preset current draw.

10. The method as recited in claim 9, further comprising outputting a warning signal when said computer processor assesses that said maximum current draw is less than said preset current draw.

11. The method as recited in claim 8, further comprising using the computer processor to monitor a rate of current decrease over time.

12. The method as recited in claim 11, further comprising using the computer processor to indicate said electrodeposition coating should be stopped when said rate of current decrease indicates a desired thickness of paint on said workpieces has been reached.

13. The method as recited in claim 6, wherein said adjusting step includes:

using a computer processor to determine whether said rate of current increase is too fast; and using the computer processor to decrease a rate of a voltage supplied to said electrodes when said rate of current increase is too fast.

14. The method as recited in claim 6, wherein adjusting step includes:

using a computer processor to determine whether said rate of current increase is too slow; and using the computer processor to increase a rate of a voltage supplied to said electrodes when said rate of current increase is too slow.

15. The method as recited in claim 6, wherein said adjusting step includes:

determining whether said rate of current increase is too fast; and decreasing a conveyance speed of said workpieces when said rate of current increase is too fast.

16. The method as recited in claim 6, wherein said adjusting step includes:

determining whether said rate of current increase is too slow; and increasing a conveyance speed of said workpieces when said rate of current increase is too slow.

17. A system for controlling electrodes in an electrodeposition tank during electrodeposition coating of workpieces comprising:

a display;

a detector which detects a current from the electrodes during said electrodeposition coating;

means for connecting said detector to said display to display a plot for current versus time for said electrodes; and a computer for controlling said electrodeposition coating, said computer increasing a voltage applied to said workpieces during initial electrodeposition coating, determining when an inflection point of the plot has been attained, ceasing said increasing voltage when said inflection point has been attained, and halting said electrodeposition coating when the current falls below a preselected terminal current level indicative of a desired thickness of the electrodeposition coating, wherein said ceasing step continues to cease said increasing voltage until said halting step halts said electrodeposition coating.

18. The system as recited in claim 17, wherein said detector comprises a detector for each of said electrodes and said means for connecting includes a selector which selects among rectifiers connected to said detectors and an analog-to-digital converter which converts a signal received from said selector into digital form to be output to said display.

19. The system as recited in claim 17, wherein said display simultaneously displays a plot for each of said electrodes.

20. The system as recited in claim 19, wherein said computer controls a slope of said plot by altering at least one of a voltage supplied to said electrodes and a conveyance speed of said workpieces.

21. The system as recited in claim 17, wherein said computer outputs a warning signal when said computer assesses that said inflection point is less than a preset value.

22. A system for controlling electrodes in an electrodeposition tank during electrodeposition coating of workpieces comprising:

means for monitoring a plot of current versus time for said electrodes; and means for controlling said electrodes, including increasing a voltage applied to said workpieces during initial electrodeposition coating, determining when an inflection point of the plot has been attained, ceasing said increasing voltage when said inflection point has been attained, and halting said electrodeposition coating when the current output falls below a preselected terminal current level indicative of a desired thickness of the electrodeposition coating, wherein said ceasing step continues to cease said increasing voltage until said halting step halts said electrodeposition coating.

23. The system as recited in claim 22, further comprising:

means for outputting a warning signal when said inflection point is less than a preset value.

* * * * *